United States Patent [19]

Rust et al.

[11] Patent Number: 5,020,246

[45] Date of Patent: Jun. 4, 1991

[54] GRAIN DRYING SYSTEM

[75] Inventors: Marcus D. Rust, Seymour; Jeffrey L. Wilson, Brook; Harmon L. Towne, Goshen, all of Ind.

[73] Assignee: CTB, Inc., Milford, Ind.

[21] Appl. No.: 505,719

[22] Filed: Apr. 6, 1990

[51] Int. Cl.[5] ..... F26B 19/00; F26B 25/00

[52] U.S. Cl. ..... 34/236; 34/174; 34/211; 34/233

[58] Field of Search ..... 34/233, 236, 174, 211; 98/55

[56] References Cited

U.S. PATENT DOCUMENTS 3,479,748 11/1969 Sietmann ..... 34/174 X 4,217,701 8/1980 Mathews ..... 34/174 X

*Primary Examiner*—Edward G. Favors

*Attorney, Agent, or Firm*—Richard Bushnell

[57] ABSTRACT

A grain bin structure having an inverted frusto-conical interior drying floor dividing the bin structure into a drying chamber and a storage chamber, and a transfer means comprising a rotating helical conveying system for transporting grain from the drying chamber to the storage chamber, said rotating helical conveying system having inlet means in communication with the drying chamber and outlet means in communication with the storage chamber. Preferably, the bin structure further comprises control means for sensing the moisture content of the grain in the drying chamber and for signaling activation of the transfer means when the moisture content reaches a predetermined level. The grain bin structure may also include improved diverter means for insuring complete transfer of the grain from the drying chamber to the storage chamber and deflector means for promoting even piling of the grain within the storage chamber.

10 Claims, 3 Drawing Sheets

GRAIN DRYING SYSTEM

BACKGROUND OF THE INVENTION

1. Field of the Invention

This invention relates generally to apparatus for drying and storing grain within a grain bin, and more particularly to a rotating helical conveying system for moving the grain from a drying chamber to a storage chamber within the grain bin.

2. Description of Related Art

As discussed in U.S. Pat. No. 3,501,845, one type of apparatus which is used for drying grain comprises an inverted frusto-conical perforated drying floor mounted in a conventional grain bin above a base floor thereof. Raw grain is loaded onto the drying floor through an opening in the top of the grain bin and thereafter air dried by, for example, a blower system circulating air upwardly through the perforated drying floor. Once dry, the grain is dumped onto the base floor through discharge spouts in the drying floor controlled by trap door-type valves.

Another example of this type of grain drying apparatus is shown in U.S. Pat. No. 4,035,928, wherein the dried grain is unloaded from the drying floor 50 through openings 60 controlled by similar trap door-like valves 62 and 64. The '928 patent further discloses the use of a stiffening tube 23 secured to the underside of the grain drying floor to improve strength and support.

Still other examples of grain drying apparatus of the type to which the present invention relates are seen in U.S. Pat. No. 4,587,893 which discloses a tension band 28 extending around the lower circumference of the drying floor to improve the transmission of weight forces; U.S. Pat. No. 4,589,332 which discloses a flashing system 40 aimed at preventing the accumulation of grain at the juncture of the drying floor and the wall of the bin; and U.S. Pat. No. 3,943,636 which shows a hydraulic torque converter operatively connected to the drying floor discharge valves for moving the valves between open and closed positions.

One common problem associated with grain drying apparatus of this type is the general complexity of the mechanisms needed to operate the drying floor discharge outlet valves, which in some cases include numerous chains, levers, manual control rods or hydraulic cylinders in order to raise and lower the trap door-like valves controlling the discharge outlets. These types of mechanisms also make precise control over the amount of grain passing through the discharge outlets very difficult. Moreover, the problem of controlling the amount of grain discharged is often aggravated by trash or other debris becoming lodged in the discharge outlets of the type discussed above.

SUMMARY OF THE INVENTION

It is a principal objective of the present invention to provide apparatus for drying and storing grain within a grain bin including a rotating helical conveying system for transporting grain from a drying chamber to a storage chamber.

It is a related objective to provide apparatus for drying and storing grain which is much less complex than known apparatus of this type, provides better control over the amount of grain being transported from the drying chamber to the storage chamber and prohibits clogging of the grain discharge apertures.

It is a collateral objective of the present invention to provide means for automatically operating said rotating helical conveying system for transporting grain when a predetermined moisture content in the grain being dried is achieved.

Another objective of the present invention is to provide an improved means for diverting the dried grain into the means for transporting the grain from the drying chamber to the storage chamber Still another objective of the present invention is to provide means to evenly distribute the grain within the storage chamber.

Other objectives and advantages of this invention will become apparent upon reading the following detailed description and upon reference to the drawings. Throughout the description, like reference numerals refer to like parts.

Summarily stated, the present invention comprises a grain bin structure having an interior drying floor dividing said structure into a drying chamber and a storage chamber, and transfer means for transporting grain from said drying chamber to said storage chamber, wherein said transfer means comprises a rotating helical conveying system having inlet means in communication with said drying chamber and outlet means in communication with said storage chamber. The apparatus may further comprise control means operatively associated with said transfer means for sensing the moisture content of the grain being dried and for automatically activating the transfer means when said moisture content reaches a predetermined level. Improved diverter means for insuring complete transfer from the drying chamber to the storage chamber and deflector means for evenly distributing the grain within the storage chamber may also be provided.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following descriptions taken in connection with the accompanying drawings, in which:

DETAILED DESCRIPTION OF THE ILLUSTRATED EMBODIMENT

While the invention will be described in connection with a preferred embodiment, it will be understood that it is not intended to limit the invention to that embodiment. On the contrary, it is intended to cover all alternatives, modifications and equivalents as may be included within the spirit and scope of the invention.

Figure 1:
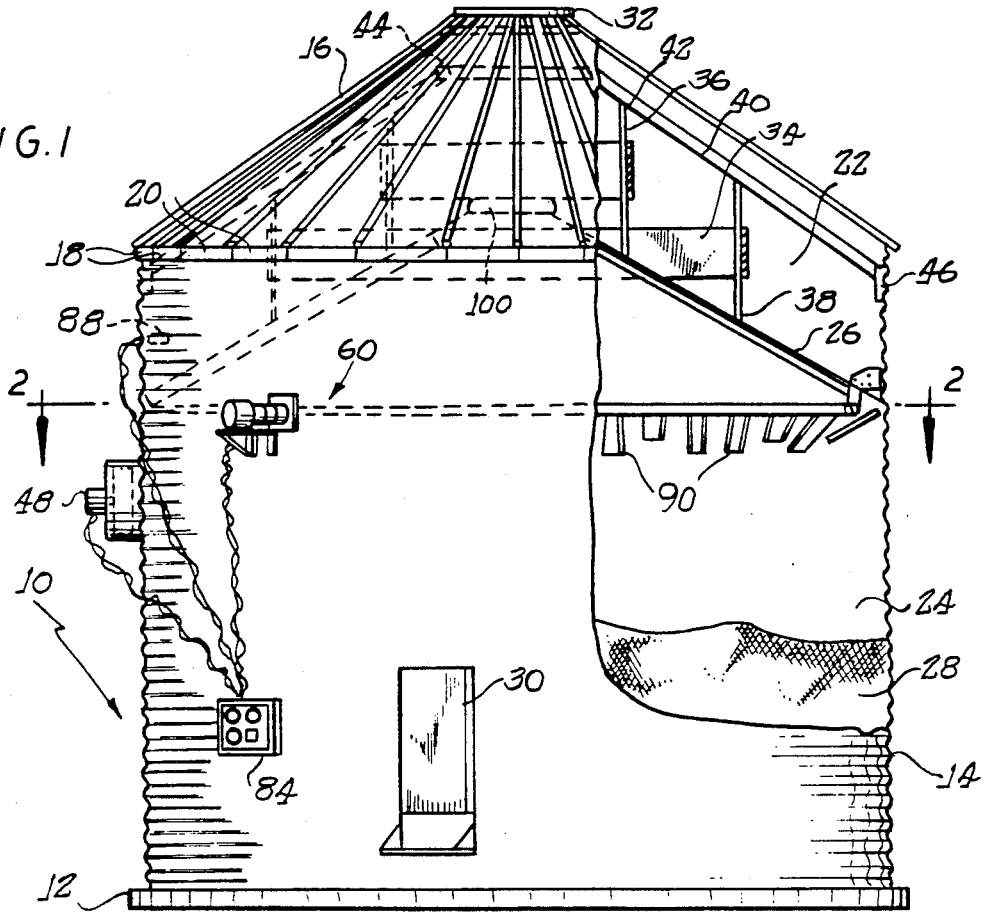
FIG. 1 is an elevational view of the invention, partially in section.

In FIG. 1 there is shown a grain bin 10 having a base floor 12 which supports a cylindrical side wall 14 in known fashion. A conventional bin roof structure 16 is also included and preferably the bin 10 is equipped with ventilation apparatus of the type described in U.S. Pat. No. 4,867,046 entitled "Vent System for Storage Bins", which patent is incorporated by reference herein. The '046 patent vent system comprises a series of brace members such as those depicted by reference numeral 18 used to elevate and hold the roof structure 16 at a predetermined, fixed height above the side wall 14 thereby creating numerous air vents 20. The air vents 20 significantly improve air circulation within the grain bin 10 which promotes uniform drying within the bin and minimizes condensation on the side wall 14. Further details of the venting system are available in the '046 patent and are therefore omitted here.

Closer inspection of FIG. 1 reveals that the bin 10 is divided into an upper drying chamber 22 and a lower storage chamber 24 by a drying floor 26. Access to dried grain 28 which has deposited in the storage chamber 24 can be gained through man door 30 when so desired.

In operation, a batch of undried grain is dumped into the drying chamber 22 through a fill hole 32 formed in the roof structure 16. As the grain descends onto the drying floor 26, it passes through leveling bands 34 which are positioned in its path as illustrated and function to ensure a level distribution of grain on the drying floor 26. The leveling bands 34 are mounted on support posts 36 which are secured to the drying floor 26 at lower ends 38 thereof, and fastened to support rafters 40 at upper ends 42. The support rafters 40 are positioned substantially parallel to the drying floor 26 and extend between a central compression ring 44 and stiffeners 46 which are bolted to the bin wall 14. Rafters 40 and posts 36 thereby provide the principal support for the drying floor 26 and the grain being dried thereon.

Figure 3:
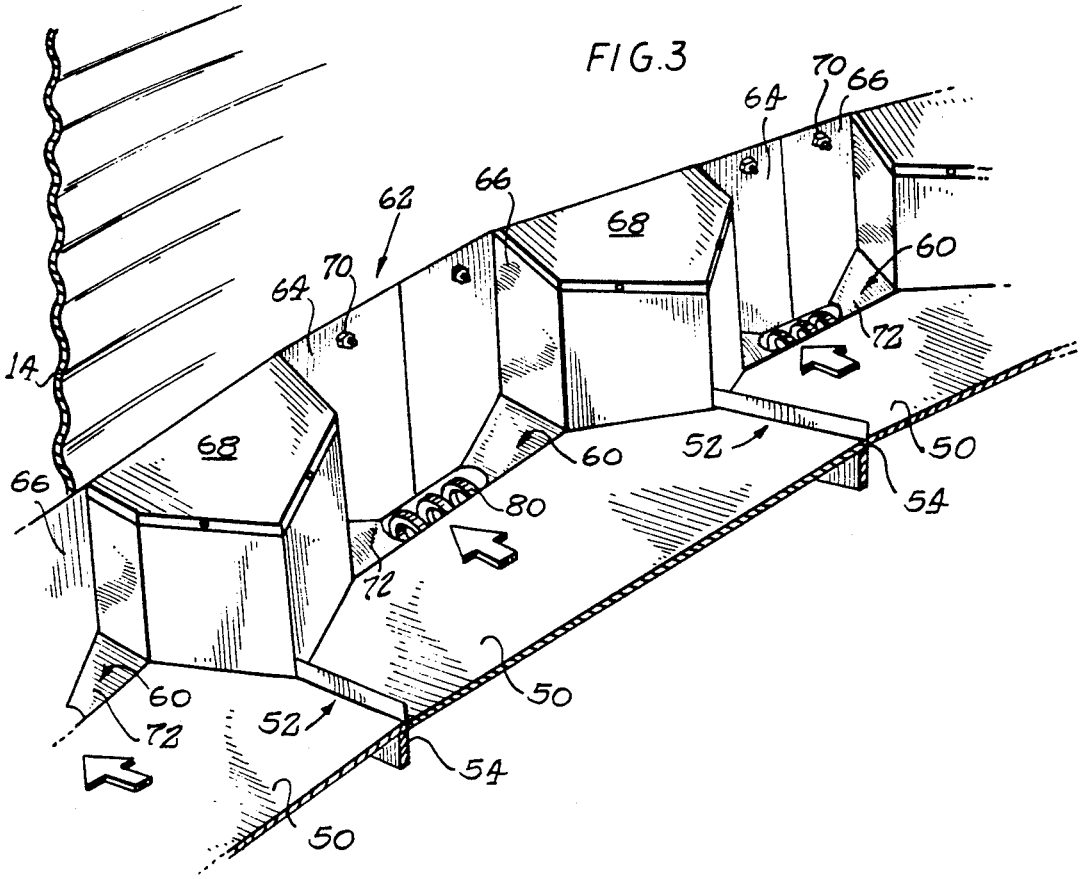
FIG. 3 is an enlarged fragmentary plan view showing a portion of the invention in the area of the transfer means.
Figure 4:
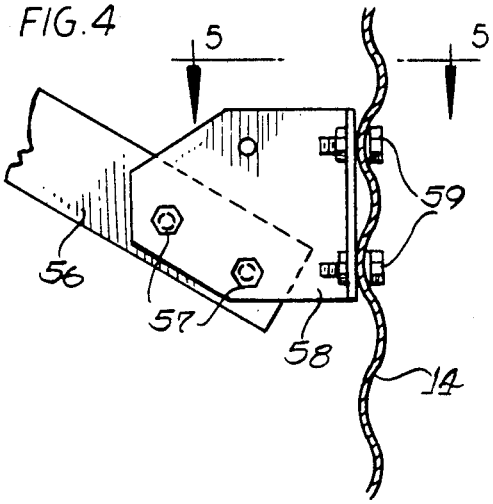
FIGS. 4 and 5 are fragmentary views showing some of the components used to support the drying floor.
Figure 5:
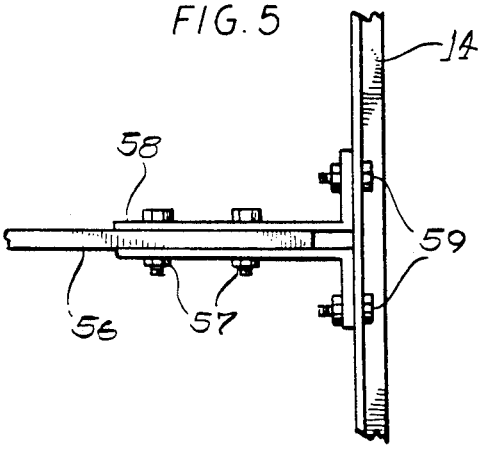

Once a batch of undried grain has been deposited onto the drying floor 26, an air blower system 48 is activated and drying air is forced upwardly through the inclined drying floor 26 which is constructed of perforated wedge-shaped panels 50 (FIG. 3) made from a material such as metal mesh or high-strength screening. The individual panels 50 are joined together at junctions 52 to form the inverted frustro-conical drying floor 26 which is provided with additional support from composite floor beams 54 which are secured at lower ends 56 thereof to sidewall brackets 58 by bolts 57. The sidewall brackets 58 are in turn are fastened to the bin sidewall 14 by fasteners 59, as best seen in FIGS. 4 and 5.

Once dry, the incline of the drying floor 26 causes the grain to travel toward the bin wall 14. Referring to FIG. 3, it can be seen that a plurality of floor openings 60 are formed in each of the wedge-shaped floor panels 50 near the juncture of the panels 50 and the bin wall 14. In order to make sure that all the grain on the drying floor 26 will eventually reach the floor openings, diverter means 62 are provided as illustrated at the juncture of the drying floor 26 and bin wall 14. Each diverter means 62 preferably comprises a left side member 64, a right side member 66 and a cap 68. When securely fastened in place by bolts 70, the diverter means 62 effectively functions to minimize the possibility of grain becoming trapped between the bin wall 14 and floor openings 60 and/or between the adjacent floor openings 60.

Figure 2:
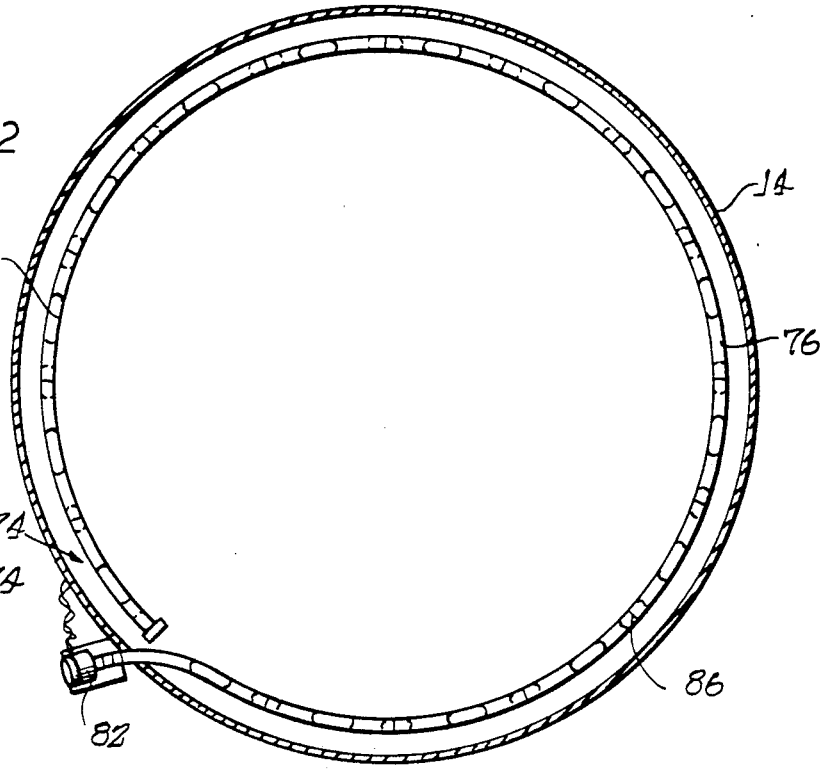
FIG. 2 is a sectional view taken along line 2—2 shown in FIG. 1.
Figure 6:
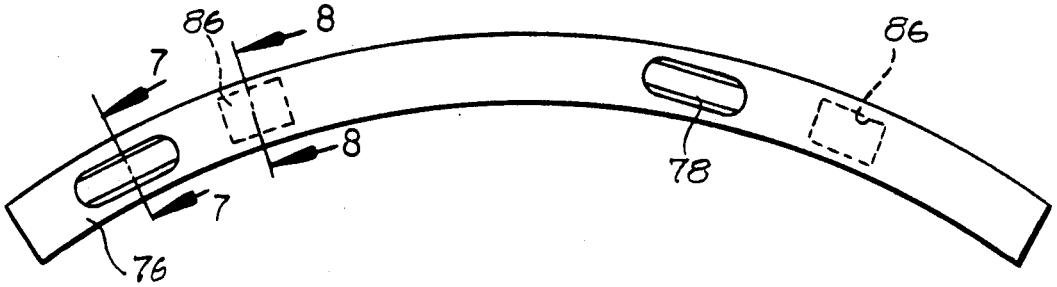
FIG. 6 shows a portion of the rotating helical conveying system broken-away from the remainder of the invention.

Further in accordance with the invention, a grain chute 72 is positioned within each floor opening 60 which functions to funnel the grain descending from the drying floor 26 (in the direction of the arrows shown in FIG. 3) into a transfer means 74. As best seen in FIGS. 2 and 6, the transfer means 74 first comprises a conveyor housing 76 having inlets 78 disposed beneath each grain chute 72.

Figure 2A:
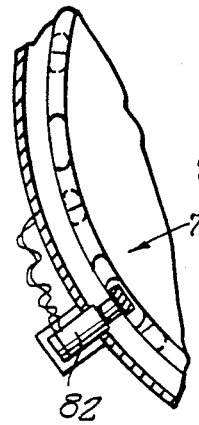
FIG. 2A is a fragmentary view showing a modification of the transfer means shown in FIG. 2.

In order to move the grain through the housing 76, the transfer means 74 further comprises a helical conveying element 80 operatively associated with a single electric motor 82 shown in FIGS. 2 and 2A. The helical conveying element 80 can either be of a finite length extending from the single electric motor 82 around substantially the entire circumference of the bin 10 as shown in FIG. 2; or can take the form of a continuous loop extending around the circumference of the bin 10 as shown in FIG. 2A. In the embodiment shown in FIG. 2, the helical conveying element 80 is rotationally driven by the motor 82, and in the embodiment shown in FIG. 2A, the element 80 is primarily axially driven, with a slight simultaneous rotation also provided. An electric supply is provided for both the motor 82 and blower 48 by a control panel 84 as illustrated in FIG. 1. Once activated, the motor 82 will rotate the helical conveying element 80 thereby causing grain entering the housing 76 through inlets 78 to be forced along the housing 76 until reaching one of a series of conveyor outlets 86 formed in the housing as best shown in FIGS. 2 and 6. The grain then falls through the outlets 86 and into the storage chamber 24 where it is stored until needed.

As compared to the prior art methods discussed above, use of the transfer means 74 enables precise control over the amount of the grain moving from the drying chamber 22 into the storage chamber 24. Moreover, transporting the grain from the drying chamber 22 to the storage chamber 24 by use of the helical conveying element 80 as described, also eliminates the possibility of trash or debris clogging the flow of the grain since any trash or debris will be forced through the housing 76 and out of one of the outlets 86. Use of the transfer means 74 also enables an entire batch of dry grain to be deposited into the storage chamber 24 by operating only a single driving motor 82, as opposed to the numerous chains and pulleys or hydraulic devices as are required in the prior art systems discussed.

Preferably, a sensing probe 88 (FIG. 1) is located within drying chamber 22 to measure the amount of moisture in the batch of grain being dried and to send a signal to a control panel 84 when a predetermined level of moisture is reached. Upon receipt of the appropriate signal, the control panel 84 will activate the electric motor 82 and thereby automatically transfer the dried batch of grain into the storage chamber 24.

It should be noted that the description of the invention in connection with a "batch" of grain is for purposes of explanation and illustration only and is not intended to limit the application and uses of the invention in any way. For example, it will be understood that the elements of the invention could be used in a "continuous" rather than "batch" manner whereby grain sufficiently dried would be transfered to the storage chamber 24 and additional undried grain would be added to the drying chamber 22 through fill hole 32.

Deflectors 90 (FIG. 1) can also be provided to attain substantially uniform piling of the stored grain on the base floor 12. In the example illustrated, the deflectors 90 are mounted to the bin wall 14 at an approximately 30° angle with the horizontal below each of the conveyor housing outlets 86 and vary in length from short to medium to long such that a substantially flat pile of dried grain 28 will be developed.

Figure 9:
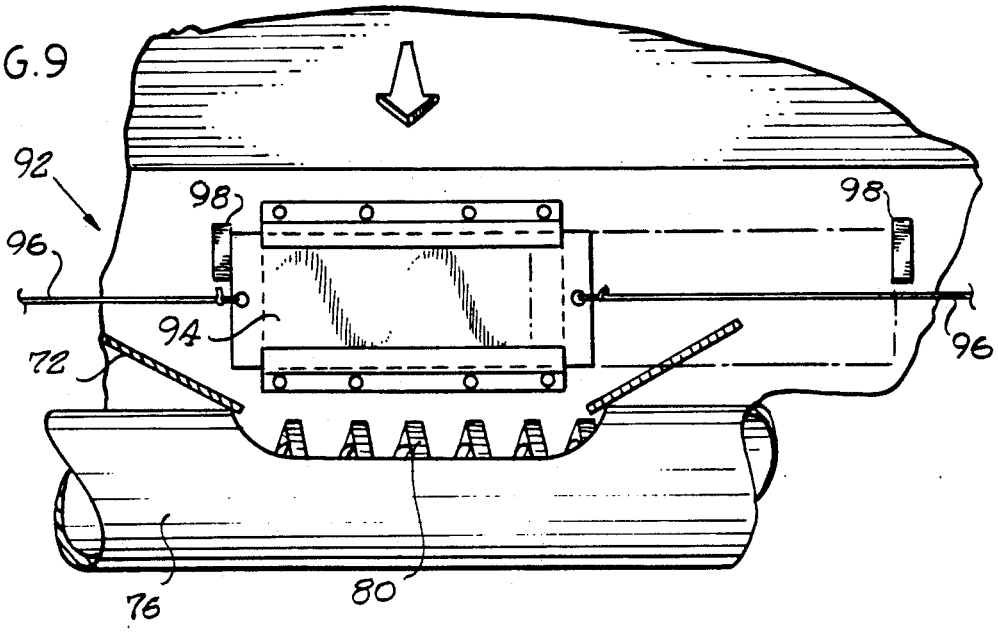
FIG. 9 is a fragmentary sectional view of an emergency dump feature of the invention.
Figure 7:
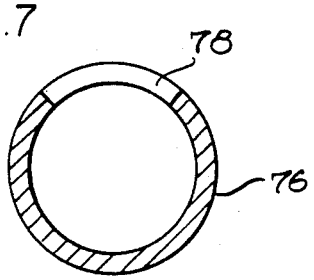
FIG. 7 is a sectional view taken along line 7—7 shown in FIG. 6.
Figure 8:
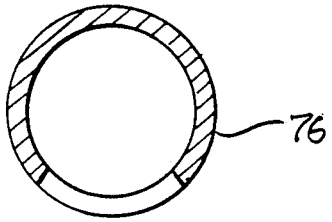
FIG. 8 is a sectional view taken along line 8—8 shown in FIG. 6.

In some circumstances, it may be necessary to unload grain from the drying floor 26 into the storage chamber 24 without utilizing the transfer means 74 as described above. For this reason, emergency dump means 92 as illustrated in FIG. 9 are also provided comprising a plurality of sliding doors 94 located in each grain chute 72 below the drying floor 26. Operation of the trapdoors 94 can be accomplished by any of several known methods (such as a cable 96 and stop 98 system) which would be readily available to a person having ordinary skill in this art and therefore will not be discussed in detail here.

Similarly, under certain circumstances, an operator might desire to unload undried grain directly into the storage chamber 24 and completely bypass the drying floor 26. Accordingly, a drying floor cap 100 is provided at the apex of the drying floor 26 as shown in FIG. 1. The drying floor cap 100 is located substantially directly below the fill hole 32 so that grain deposited in the fill hole 32 will travel directly onto the base floor 12.

The invention is claimed as follows:

1. Apparatus for drying and storing grain comprising: a grain bin structure having an interior drying floor dividing said structure into a drying chamber and a storage chamber; and transfer means for transporting grain from said drying chamber into said storage chamber; said transfer means comprising a conveying system having inlet means in communication with said drying chamber, outlet means in communication with said storage chamber, and an elongate helical conveying element in the form of a continuous loop.

2. Apparatus as recited in claim 1, wherein said transfer means is operatively associated with control means for sensing the moisture content of the grain held in the drying chamber and for automatically activating the transfer means when said moisture content reaches a predetermined level.

3. Apparatus as recited in claim 1, wherein said outlet means are operatively associated with deflector means for evenly distributing grain within said storage chamber.

4. Apparatus for drying and storing grain comprising: a grain bin structure having an interior drying floor dividing said structure into a drying chamber and a storage chamber; transfer means for transporting grain from said drying chamber into said storage chamber; said transfer means comprising and conveying system having inlet means in communication with said drying chamber and outlet means in communication with said storage chamber; and alternate unloading means for moving grain from the drying chamber into the storage chamber in greater quantity and less time than is possible utilizing said transfer means.

5. Apparatus as recited in claim 4, wherein diverter means are provided for insuring the complete transfer of grain from the drying chamber to the storage chamber.

6. A storage and drying system for use in a grain bin comprising a drying floor separating the grain bin into upper and lower compartments, and passage means for unloading dried grain from said upper compartment into said lower compartment for dry storage, said passage means comprising an elongate conveyor element extending substantially around a lower perimeter of said drying floor and a housing for carrying said conveyor having apertures formed therein for receiving grain from said upper compartment and for delivering grain into said lower compartment.

7. Apparatus as recited in claim 6, wherein said elongate conveyor element extends completely around said lower perimeter of said drying floor in the form of a continuous loop.

8. Apparatus as recited in claim 6, further comprising a single power source for driving said elongate conveyor element.

9. Apparatus as recited in claim 6, wherein said passage means is operatively associated with control means for sensing the moisture content of the grain held in said upper chamber and for automatically activating the passage means when said moisture content reaches a predetermined level.

10. Apparatus as recited in claim 6, wherein diverter means are operatively associated with said passage means for insuring the complete transfer of grain from said upper chamber into said lower chamber.

* * * * *